United States Patent [19]

Denes

[11] 4,100,525

[45] Jul. 11, 1978

[54] SINGLE SETTING VARIABLE RESISTOR

[75] Inventor: Oscar L. Denes, Milwaukee, Wis.

[73] Assignee: Allen-Bradley Company, Milwaukee, Wis.

[21] Appl. No.: 684,709

[22] Filed: May 10, 1976

[51] Int. Cl.[2] ..... H01C 10/00

[52] U.S. Cl. ..... 338/195; 29/620

[58] Field of Search ..... 338/195; 29/620

[56] References Cited

U.S. PATENT DOCUMENTS

| | | | |
|---|---|---|---|
| 1,962,438 | 6/1934 | Flanzer et al. | 338/195 X |
| 2,051,517 | 8/1936 | Creager | 338/195 X |
| 2,500,605 | 3/1950 | DeLange et al. | 338/195 X |
| 2,759,078 | 8/1956 | Brown, Jr. | 338/195 X |
| 3,211,031 | 10/1965 | Martin | 338/195 X |
| 3,594,679 | 7/1971 | Seay et al. | 378/195 |
| 3,851,293 | 11/1974 | Clayton | 338/195 |
| 3,889,223 | 6/1975 | Sella et al. | 29/620 X |

*Primary Examiner*—C. L. Albritton
*Attorney, Agent, or Firm*—Arnold J. Ericsen

[57] ABSTRACT

A variable resistor having an insulating substrate, a resistive film applied to the surface of the substrate and spaced terminals supported by the resistor and in electrical connection with the resistive film. The resistance of the film is adjusted by means of scribing to remove portions of the film to provide a means of isolating certain areas of the film to increase the resistance of the electrical path between the terminals. Embodiments of the assemblage are disclosed wherein the scribing tool may provide an arcuate configuration or a linear configuration to provide desired resistance values.

10 Claims, 8 Drawing Figures

SINGLE SETTING VARIABLE RESISTOR

BACKGROUND OF THE INVENTION

Variable resistor devices for "trimming" electrical circuits are quite well-known and have come into extensive use over the past years. in general, such devices, in contrast to potentiometers, are "set and forget" devices in which the resistance is varied until a preselected circuit condition is achieved. Every effort has been made to simplify these devices and to reduce the number of components in order to provide desired miniaturization compatible with the remaining components of a circuit.

Inevitably, these devices include a dielectric or insulating substrate having a resistive layer deposited thereon and two or more oppositely disposed terminals electrically connected to the resistive layer. In addition, the prior art devices have included a movable brush contact or brush member joined to another terminal before contacting the resistive layer and varying the resistance between respective terminals.

It will be obvious that there is a need for a device that the ultimate customer can simply set to a desired value, which in most instances requires a single setting for the life of the variable resistance device. A single in situ adjustment eliminates the need for a movable brush type contact. Eliminating all but the most essential elements greatly reduces cost and simplifies manufacture. It will also be apparent that there is always the possibility of the adjustable brush moving from the desired position under vibratory conditions, or by unintended contact during other circuit adjustments.

It is recognized that resistance trimming per se is well-known in the art. In fact, the assignee of the present application was also assigned U.S. Pat. No. 2,953,764 for a fixed resistor having a particular grid configuration, wherein certain sections of the grid could be removed to adjust resistive values. A somewhat similar device is illustrated in the Seay et al. U.S. Pat. No. 3,594,679 and U.S. Pat. Nos. 2,759,078 and 3,517,436 granted to Brown and Zandman et al., respectively.

It will be apparent, however, that although each of these patents disclose a means for removing a resistive film, such means either requires an elaborate scribing mechanism or other mechanism that is dependent upon "factory" trimming. No structures provide circuit trimming devices for field application by the ultimate customer, other than the relatively elaborate movable contact brush type constructions.

The Ghegan U.S. Pat. No. 1,618,003 and the Appleby U.S. Pat. No. 1,583,105 are illustrative of devices utilizing a means of applying or depositing a resistive track to a substrate by means of a graphite brush. These devices are relatively complicated and require that the brush remain on the track to complete the resistive circuitry between oppositely disposed terminals.

SUMMARY OF THE INVENTION

The present invention contemplates a means for adjusting the resistance of an electrical circuit component including a resistive film layer deposited on an insulating substrate, and including a temporarily applied scribing tool for scribing or cutting a path in the resistive layer. The tool is removed after the desired resistance adjustment has been attained.

The invention further contemplates the provision of a tool for adjusting the resistance value of the resistive layer deposited on an insulating substrate of an electrical resistor. The tool may be removed after the adjustment has been made and utilized for making further adjustment of the resistance, if necessary. In addition, the tool is adapted for use with other similar variable resistance devices adapted for receiving and cooperating with the operation of the tool.

It is an object of the present invention to provide a "set and forget" resistor of a most simplistic and economical design and construction defining an insulating substrate, a deposited resistance film on the substrate, and two or more terminals in electrical engagement with the resistance film. The resistor is arranged to receive a scribing tool which may be removed after a desired resistance value has been attained.

It is another object of this invention to provide a circuit trimming resistor which may be trimmed in situ with a trimming tool and which has no movable parts which can change circuit adjustment under vibratory conditions or accidental contact.

DETAILED DESCRIPTION

Figure 1:
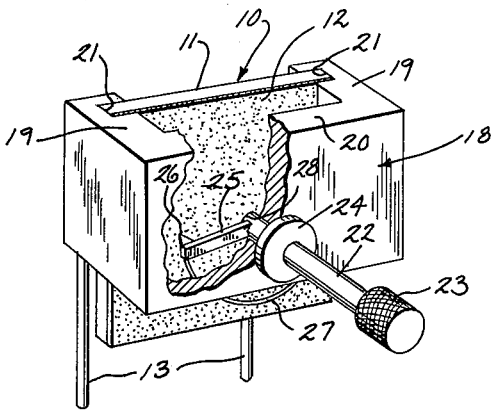
FIG. 1 is a perspective view of a resistor and a device for scribing an arcuate path in the resistor layer in accordance with the teachings of the present invention.
Figure 2:
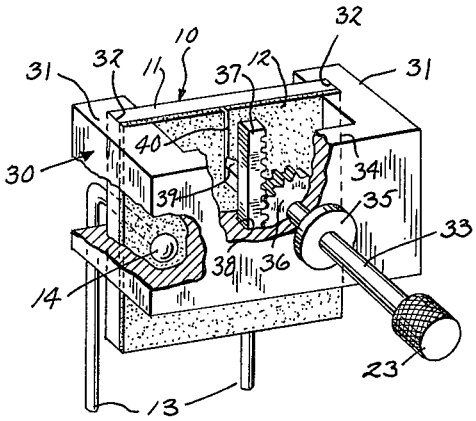
FIG. 2 is a perspective view of another embodiment of a scribing device supporting a resistor, and arranged to scribe a straight line or lines in the resistive surface material.
Figure 3:
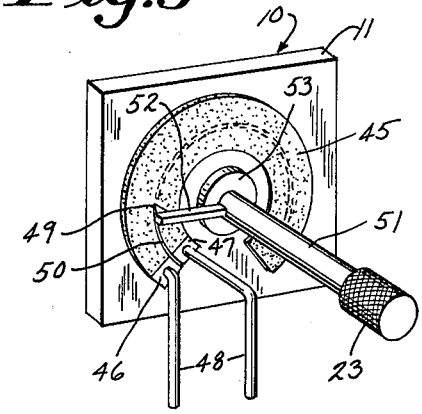
FIG. 3 is a perspective view of still another scribing device and resistor combination in accordance with this invention.
Figure 4:
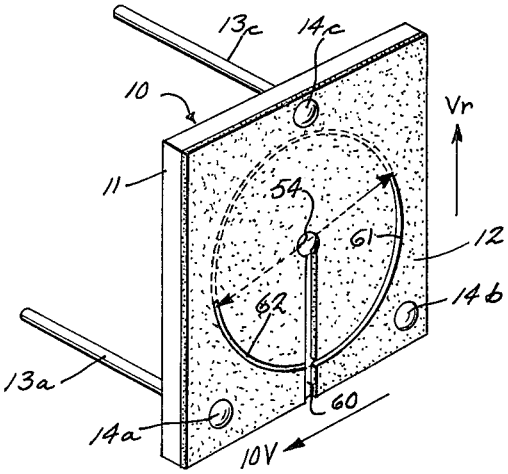
FIG. 4 is a perspective view of a resistor which has been trimmed to a preselected value in accordance with the teachings of the present invention.

FIGS. 1–3 are illustrative of several embodiments of the present invention, each of which illustrates a device for scribing an area on a preformed resistor to attain a desired resistive value. With reference first to FIG. 1, the resistor 10 comprises an insulating substrate 11 which may be of a ceramic or plastic material, or any material compatible with and capable of supporting a layer 12 of resistive material. The resistive layer may be of a carbon film, a metallic thin film, a conductive ink or other known resistive materials. The particular materials chosen for the insulating substrate 11 and resistive layer 12 are not the subject of the present invention. However, for completeness of disclosure, a typical substrate was molded from a glass reinforced polyester resin commercially offered by the General Electric Company of Pittsfield, MA., as Valox 420. A typical resistive layer compatible with the Valox substrate material is Electrodag 250 marketed by Acheson Colloids Company of Port Huron, MI. This resistance coating cures to a typical sheet resistance of 75,000 ohms/-square at 1 mil thickness. It is a well-known coating for printing resistance layers. The resistive coating layer 12 may be applied by any of several methods, such as brushing, dipping, silk screening or other known deposition procedures. The circuit trimming resistor 10 in its simplest form is shown in FIGS. 1–4. Laterally spaced terminal leads 13 are assembled to the resistive layer 12 and the substrate 11 in such manner as to make electrical contact with the resistive layer 12. As shown in FIG. 4, the leads 13*a*, 13*b* (not shown) and 13*c* are headed at 14*a*, 14*b* and 14*c*, respectively, to provide electrical connection with the layer 12. It will be noted that the embodiment of FIG. 4 utilizes three spaced apart leads for purposes which will be described hereinbelow.

For purposes of clarity, it will be understood that throughout the present description, like reference numerals refer to like parts in the various drawing figures.

With attention being directed to FIG. 1, it will be noted that the resistor 10, shown here unmounted for ease in description, is adapted to receive a fixture 18. The fixture 18 comprises a generally U-shaped member including two opposed leg portions 19 joined by an integral crossbar portion 20. The leg portions 19 are each grooved at 21 to slidably receive the resistor 10. The crossbar portion 20 is arranged to rotationally support a shaftlike scribing tool 22. The tool 22 terminates in a manually rotatable knurled knob portion 23 extending outwardly of the fixture 18. A radially extending flange member 24 acts as a stop to further support the scribing tool 22 upon insertion of the tool 22 into an aperture 28 of the resistor 10. The portion of the shaft 22 extending internally of the fixture 18 includes a radially extending support arm 25 from which depends a hardened scribe member 26. It will be apparent that rotation of the scribing tool 22 will cause the scribe portion 26 to physically remove an arcuate path of material 27 from the resistive layer 12.

The embodiment of FIG. 2 is illustrative of a fixture 30 having a generally U-shaped configuration defining two opposed legs 31, each of which include grooves 32 for slidably receiving the resistor 10. It will be apparent that both the resistors 10 in FIGS. 1 and 2 include terminals 13 which are supported normally relative to the surface bearing the layer 12 of resistor 10 and bent downwardly as shown. They include the headed portions 14 (see FIG. 2) for electrical engagement with the resistive layer 12.

It will be apparent from FIG. 2 that the present embodiment includes a shaftlike scribing tool 33 journaled in the crossbar portion 34 of the fixture 30. Again, a stop member is provided at 35 externally of the fixture 30 and, in this case, a rack and pinion mechanism is provided by means of a pinion gear 36 fastened to an inwardly extending portion of the shaftlike scribing tool 33, which gear engages a linearly movable toothed rack member 37. The fixture 31 is provided with a groove 38 for slidably receiving and guiding the rack member 37. The rack member 37 includes an inwardly extending scribe 39 arranged to remove a portion of the resistive layer 12 in a linear path 40.

It will be apparent that in both the embodiments of FIGS. 1 and 2, the resistor 10 may be formed as a square as shown, to thereby permit the respective fixtures 18 and 30 to temporarily receive either the vertical or horizontally extending sides to provide either annular or vertical paths in configurations as desired. It will be obvious that the resistor 12 may be formed in any desired configuration, as will become apparent from the ensuing description.

The embodiment of FIG. 3 is interesting from at least two aspects; the substrate 11 of the resistor 10 includes an arcuately configured resistive layer 45. The resistive layer 45 may be deposited by the well-known silk screening technique or any other technique that permits a layer to adhere to a substrate such as the substrate 11. In fact, it may be inlaid (not shown) in the substrate 11 when desired. As shown, one end of the resistive layer 45 includes a terminal pad 46, 47 arranged to receive and be electrically connected with the spaced terminal leads 48. The terminal pads 46, 47 may be laid down as a single pad screen printed to be in electrical connection with the resistive layer 45 (not shown). In such case, the pad may be scribed away to divide and isolate the terminals 48, or the termination may be deposited as separate pads 46 and 47, depending upon the manufacturing technique. The scribe 49 defines an arcuate path 50 on the resistive layer 45 to thereby divide the resistive layer into two portions, and in the case of a single termination pad, to also divide the pad into separate pads 46, 47. It will be apparent that as the scribe 49 of the scribing tool 51 is rotated in a clockwise direction with reference to FIG. 3, the resistance between the terminals 48 will be increased. The scribe 49 may continue along the path 50 shown in phantom advance on the clockwise motion. Obviously, it will be apparent that the scribe 49 must be stopped (not shown) in its rotative motion before reaching the opposite end of the arcuately configured resistive layer 45, or there will be a complete isolation between the two separated portions of the layer 45.

The scribing tool 51 of the embodiment of FIG. 3 is a relatively simplified tool which includes a laterally extending support 52 for the scribe 49. A radial flange 53 acts as a rest against the surface of the substrate 11, with a portion of the shaftlike tool 51 extending either into an aperture 54 (see FIG. 4), or it may be pointed (not shown) in the manner of a a draftman's compass.

FIG. 4 illustrates a 3-terminal device wherein a third terminal 13*a* acts as a connector for a voltage dividing circuit device. For instance, the resistor 10 may be manufactured with a preformed groove 60 transecting the resistive material 12, or the groove 60 may be scribed as shown in FIG. 2 by using the linearly movable rack and pinion fixture 30. A tool such as a scribing tool 51 of FIG. 3 may then be inserted in the aperture 54 to scribe the arcuate paths 61 and 62.

By way of illustration, the voltage divider application may have a 10 volt supply voltage applied between the terminal leads 13*a* and 13*b* (not shown, but which includes head 14*b*). This voltage may be compared with a voltage $V_r$ between the leads 13*b* and 13*c*. It will be apparent that this arrangement provides a voltage divider circuit and, assuming that 10 volts are applied between the leads 13*a* and 13*b* with the initial resistance measured between the leads 13*a* and 13*b* as 3.92 ohms, there will be an initial $V_r$ reading of 3.51 volts between the leads 13*b* and 13*c*. Thus, a first cut in the arcuate path 61 was found to change the voltage $V_r$ to 3.77 volts, and when another arcuate cut 62 is made, the voltage $V_r$ was reduced to 2.84 volts. There are merely arbitrary values to illustrate a manner in which a device is used as a voltage divider. A final resistance across the terminal leads 13*a* and 13*b* was read as 4.99 ohms. Obviously, area, thickness and materials will determine the initial and final values.

Figure 5:
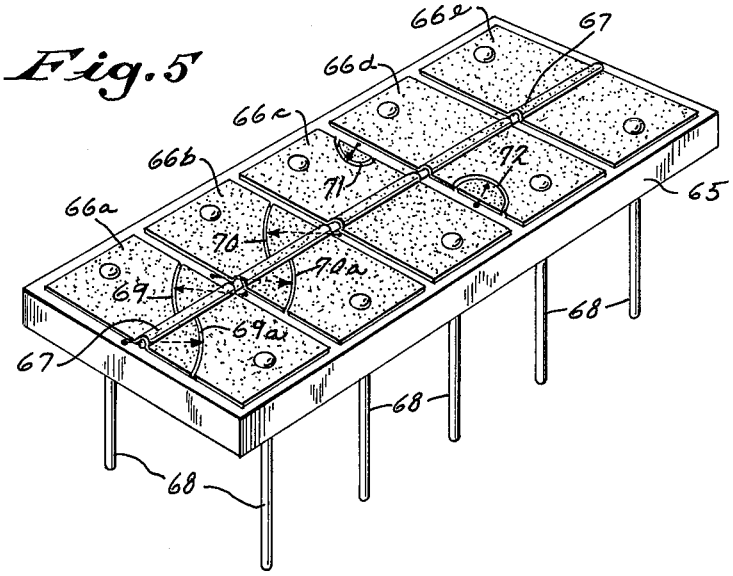
FIG. 5 is a perspective view of a resistor designed for dual-in-line packaging with a multitude of terminals and deposited resistive areas connected to such terminals.

The embodiment of FIG. 5 discloses a dual-in-line package concept utilizing the present invention. Here, an insulating substrate 65 includes a plurality of resistive layer areas 66 in longitudinally spaced relationship. It is to be noted that the substrate is preferably formed to provide an integral dividing barrier 67 extending throughout its length. A plurality of headed terminal leads 68 are retained by the substrate and are electrically connected to the respective opposite ends of the resistive layer areas 66. The reason for the raised barrier portions 67 can best be observed with reference to the resistive portions 66*a* and 66*b*. Here, a tool similar to the scribing tool 51 is utilized to define scribed paths 69 and 69*a* in area 66*a* and 70, 70*a* in area 66*b*. In order to avoid any accidental intersection of the paths 69 and 69*a* or the paths 70 and 70*a*, the barrier ridge 67 is raised and acts as a stop for the scribe as it is being rotated.

As shown, the resistive area 66*e* defines an area in which trimming is not required. However, by way of illustration, areas 66*c* and 66*d* may be trimmed with simple arcuate paths 71 and 72, respectively, which act to remove areas of the resistive material and, thereby, provide desired characteristics.

It will be apparent that in the dual-in-line embodiment of FIG. 5, variations of trimming may be accomplished by the ultimate user-customer utilizing the device in a circuit of its design, and not necessarily a circuit configuration anticipated by the supplier of the dual-in-line resistor network.

Figure 6:
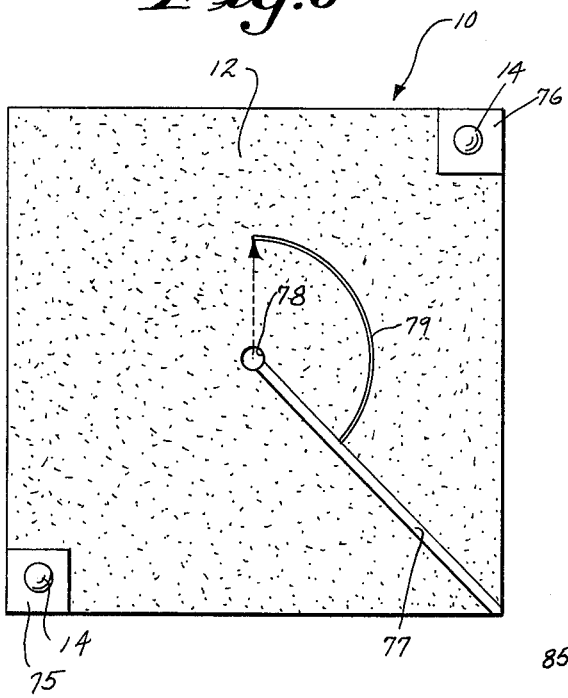
FIGS. 6 and 7 are each top plan views of resistors made in accordance with the present invention and illustrative of different scribed areas providing variations in resistance.

Referring next to the embodiment of FIG. 6, it will be apparent that the terminal pads 75 and 76 may be disposed diagonally across the resistive layer 12. A path 77 may be either factory formed, or scribed on site through the resistive layer 12 and extend from one corner of the resistor to the center aperture 78 of the resistor. The aperture 78 is arranged to receive the end of a scribing tool similar to the scribing tool 51 disclosed in the embodiment of FIG. 3. By way of example, the initial resistance between the terminal pad 75 and 76 was measured at 4.52 ohms, and by making the arcuate scribed path 79 in a manner to transect the path 77, the resistance change was found to reach a value of 8.15 ohms at midpoint of the arcuate path 79, and when the cut was completed to the configuration shown in FIG. 6, the final resistance was determined to be 8.83 ohms.

Figure 7:
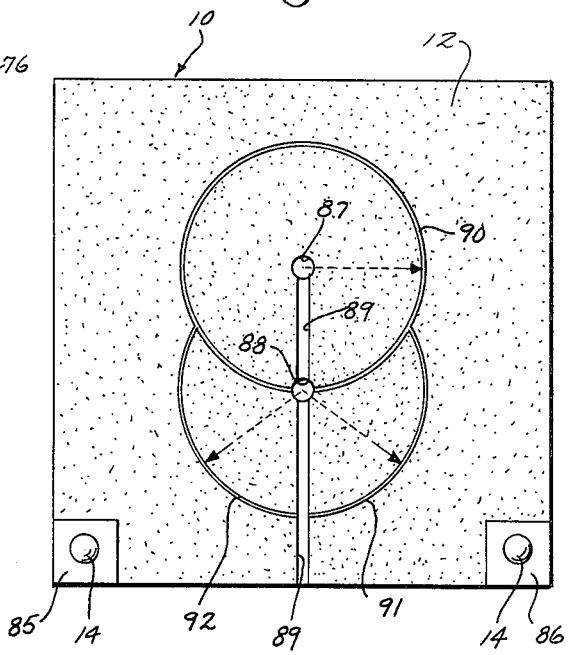

An example of fine trimming of resistance is disclosed in the embodiment of FIG. 7, wherein the resistor 10 is provided with oppositely disposed terminal pads 85 and 86 and two apertures 87 and 88. A linearly scribed path 89, which may be precut or preformed at the factory, or in the field if desired, extends between the apertures 87 and 88 and downwardly, with respect to FIG. 7, to reach the lower edge of the resistor 10 intermediate the terminal pads 85 and 86. In this embodiment, the initial resistance of the resistive layer 12, including the precut or preformed path 89, was measured at 10.34 ohms between the terminals 85 and 86. After completing the full circular cut along the path 90 with a tool, such as the scribing tool 51 illustrated in FIG. 3, the resistance was measured at 18.26 ohms between the termination pads 85 and 86. Subsequently, an arcuate path 91 was scribed to intersect the linear path 89 and the circular path 90, as shown, to provide a resistance of 18.80 ohms measured between the terminal pads 85 and 86. After the final path 92 was cut in the resistive layer 12, the resistance measured between the pads 85 and 86 was found to be 19.27 ohms.

It is of further interest to note that the setability of the device of FIG. 7 was found to be quite desirable. A resistor having an initial resistance measured between the pads 85 and 86 of 13.78 ohms could be set with a desired resistance of 15.00 ohms by inscribing an arcuate (not fully circular) path cut along the path 90 to an actual resistance of 15.10 ohms. A target resistance of 18.00 ohms was obtained on a second inscribing cut along the path 91 (not fully completed as shown) to an actual value of 18.08 ohms. In turn, with a target of 20.00 ohms, a third partial cut along the path 92 reached an actual value of 19.99 ohms. As a matter of interest, when all of the cuts were completed to the configuration shown in FIG. 7, i.e. the full circle of path 90 and the completed arcuate intersecting paths 91 and 92, the final resistance was measured at 27.46 ohms.

Figure 8:
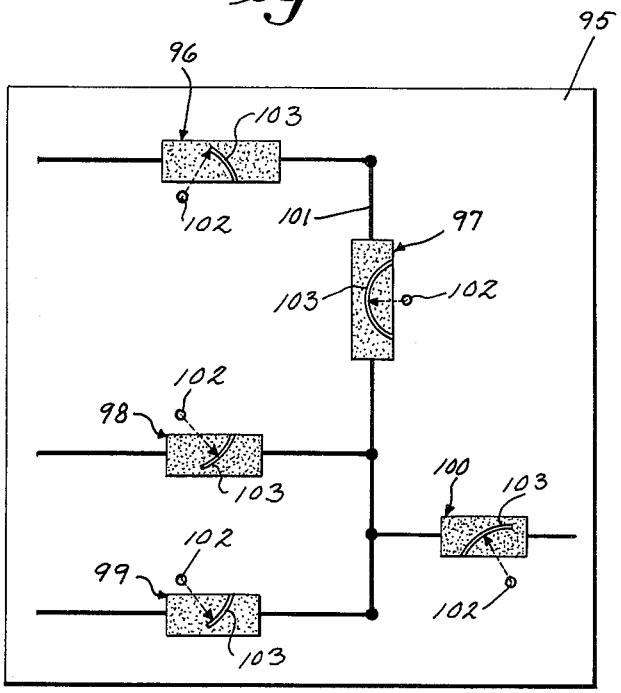
FIG. 8 is a top plan view of a "printed circuit" device utilizing several resistive areas in electrical connection with one another, and in which the circuit board is arranged to permit adjustment of resistive value in accordance with the practice of the present invention.

The embodiment of FIG. 8 provides a very convenient trimming means for a printed circuit board, or substrate 95, wherein there is provided a group of resistive areas which, for example, may include the deposited resistors 96, 97, 98, 99 and 100, each interconnected by a conducting path 101. Obviously, a printed circuit board may contain many different components (not shown), including capacitors, semiconductors and other devices which may be assembled as discrete components mounted on the board 95, or the board may include the components as an integral part thereof, in accordance with known techniques.

A scribing tool (not shown) similar to the tool 51 shown in FIG. 3 may be used to cut and define the arcuate paths 103 as a means of varying the resistance of any one or all of the resistors 96, 97, 98, 99 and 100. Apertures 102 may be made a part of the board 95, if so desired. The apertures may be formed to pass entirely through the thickness of the board 95 or partially, in the case of a non-perforated substrate.

It should be apparent to those skilled in the art that the present invention provides a simplified circuit trimming device of the "set and forget" type. That is, experience has shown that conventional circuit trimmers are rarely adjusted after an initial setting. These trimmers carry with them elements which are needed for the trimming function, but which are rarely needed after circuit adjustment is obtained. The present invention provides a circuit adjusting means which may be in the form of a single tool for circuit adjustment of a multitude of resistance devices, where the resistance devices, after adjustment, may remain in place and the means for adjustment is removed for use in adjusting other resistance devices. It is to be understood that the resistive layer to be "trimmed" may be configured in many patterns to provide linear and non-linear adjustments. Also, although the resistor 10 is disclosed with a flat resistive surface, it will be understood that it may be otherwise configured without departing from the inventive concept.

The embodiments of the invention of which an exclusive property or privilege is claimed are defined as follows:

1. A kit which makes possible trimming adjustment in the field of the resistance of a resistor adapted for connection into an electrical circuit, said kit comprising:

a. a trimmable resistor having a substrate, a resistive layer deposited upon at least a portion of said substrate, laterally spaced terminal members in electrical connection with said resistive layer and arranged for connection with the electrical circuit, at least a portion of said resistive layer being penetrable and removable for in situ trimming adjustment of said resistor;

b. a manually operable scribing tool for in situ penetration and removal of said portion of said resistive layer to trim the resistance of the resistor;

c. means for orienting said scribing tool in trimming relationship with said resistor.

2. The kit in accordance with claim 1, wherein the resistive layer of said trimmable resistor defines an arcuate configuration on the substrate and wherein two terminal members are positioned in spaced relationship at one end of said arcuate layer, and wherein said manually operable scribing tool is arranged to remove an arcuate path of resistance material to define a continuous groove dividing the resistive layer into two concentric portions beginning at the terminal end of said layer and between said terminal members and continuing in said path until a desired resistance value is obtained.

3. The kit in accordance with claim 1, wherein said scribing tool includes a manually rotatable support member, a support arm extending laterally from said support member, a scribe supported by said arm and spaced from said support member for penetration into said resistive layer of said trimmable resistor and removal of a scribed path of resistive material upon rotation of said support member; and wherein said means for orienting said scribing tool comprises at least one recess in said substrate arranged for rotative support of said support member.

4. The kit in accordance with claim 1, wherein the means for orienting said scribing tool comprises a fixture for supporting said tool and said resistor, and wherein said fixture includes means for slidably and removably receiving said trimmable resistor and means for rotatably supporting said tool in scribing relationship with said resistor.

5. The kit in accordance with claim 1, wherein said means for orienting said scribing tool comprises a fixture for supporting said trimmable resistor and said scribing tool, and wherein said fixture includes means for slidably and removably receiving said resistor and means for supporting said tool in scribing relationship with said resistor, said tool including a manually rotatable shaft having a gear at its innermost end engageable with a rack member slidably supported by said fixture and including a protruding scribe engageable with said resistive layer for removal of a scribed linear path of resistive material.

6. The kit in accordance with claim 1, wherein the trimmable resistor includes laterally spaced terminal members defining a triangular arrangement thereof, and a preformed groove extending inwardly of said resistive layer between two oppositely disposed terminal members, and wherein manual rotation of said scribing tool may be oriented with respect to said resistor to penetrate said layer in opposite directions with respect to said groove to provide a voltage dividing circuit on said resistor.

7. The kit in accordance with claim 1, wherein the substrate of said trimmable resistor supports a plurality of adjacent, spaced apart resistive layers each with oppositely disposed terminal members, and wherein respective ones of said resistive layers are arranged for individual trimming adjustment by said scribing tool to remove a continuous grooved path of resistive material in a portion of said respective layers.

8. The kit in accordance with claim 7, wherein said substrate and its respective resistive layers include a raised ribbed portion intermediate the ends of said resistive layers, and wherein said ribbed portions provide an interference means for preventing accidental intersection of paths wherein more than one grooved path is scribed in a respective resistive layer.

9. The kit in accordance with claim 1, wherein the said resistive layer extends substantially across the surface area of said substrate, and wherein said terminal members are positioned diagonally opposite one another, and wherein a preformed groove is provided in said resistive layer to lie in a plane angularly relative to the plane intersecting both of said terminal members and extending from the point of intersection of said planes to the outer edge of said substrate between said members, and wherein said scribing tool is rotatably supported for manual penetration and scribing of a groove in an arcuate path having one end intersecting said preformed groove.

10. The kit in accordance with claim 3, wherein said resistive layer includes a preformed continuous groove through its entire thickness and lying in a plane angularly relative to the plane intersecting said terminal members, and wherein said means for orienting said scribing tool includes two laterally spaced recesses in said preformed groove for rotative support of the support arm of said tool, whereby fine trimming of said resistor may be accomplished by first manually rotatively operating said scribing tool in one recess to scribe a continuous circular path through said layer, and whereby said scribing tool may be then oriented with respect to the other recess to scribe one or more continuous paths of removal material at either side of said preformed groove to intersect said preformed groove and said first scribed circular path.

* * * * *